US009925565B2

(12) United States Patent
Risi

(10) Patent No.: US 9,925,565 B2
(45) Date of Patent: Mar. 27, 2018

(54) RIDDLING DEVICE FOR RIDDLING MATERIALS AND RIDDLING BUCKET COMPRISING SAID DEVICE

(71) Applicant: SIMEX ENGINEERING S.R.L., San Giovanni In Persiceto (IT)

(72) Inventor: Mirco Risi, San Giovanni in Persiceto (IT)

(73) Assignee: SIMEX ENGINEERING S.R.L., San Giovanni In (IT)

( * ) Notice: Subject to any disclaimer, the term of this patent is extended or adjusted under 35 U.S.C. 154(b) by 35 days.

(21) Appl. No.: 14/782,807

(22) PCT Filed: Apr. 8, 2014

(86) PCT No.: PCT/IB2014/000516

§ 371 (c)(1),
(2) Date: Oct. 7, 2015

(87) PCT Pub. No.: WO2014/167407

PCT Pub. Date: Oct. 16, 2014

(65) Prior Publication Data

US 2016/0296976 A1 Oct. 13, 2016

(30) Foreign Application Priority Data

Apr. 8, 2013 (IT) ..... BO2013A0152

(51) Int. Cl.
*B07C 5/12* (2006.01)
*B07B 1/46* (2006.01)
(Continued)

(52) U.S. Cl.
CPC ..... *B07B 1/4636* (2013.01); *B07B 1/15* (2013.01); *B07B 13/04* (2013.01); *B07B 1/155* (2013.01); *B07B 13/00* (2013.01)

(58) Field of Classification Search
CPC .... B07B 1/12; B07B 1/14; B07B 1/15; B07B 1/155; B07B 1/4636; B07B 13/00; B07B 13/04; B07B 13/05; B07B 13/075
(Continued)

(56) References Cited

U.S. PATENT DOCUMENTS 1,200,241 A * 10/1916 Ritchie ..... B07B 1/15 209/672
2,640,371 A * 6/1953 Rosenleaf ..... F16H 1/006 74/392
(Continued)

FOREIGN PATENT DOCUMENTS

DE 2358022 B1 10/1974
DE 4339510 C1 1/1995
(Continued)

OTHER PUBLICATIONS

International Search Report dated Jul. 7, 2014 in PCT/IB2014/000516.

*Primary Examiner* — Joseph C Rodriguez
*Assistant Examiner* — Kalyanavenkateshware Kumar
(74) *Attorney, Agent, or Firm* — Fox Rothschild LLP

(57) ABSTRACT

Device (100) for riddling materials such as, for instance, inert materials arising from demolitions or the like or inert materials for the building industry such as gravels, sands or the like, comprising at least two riddling rollers or drums (103, 102), wherein at least one of them can be moved with respect to the other so that the distance between the axis of rotation of said at least two rollers or drums can be changed according to the needs and/or circumstances.

12 Claims, 14 Drawing Sheets

(51) Int. Cl.
*B07B 13/04* (2006.01)
*B07B 1/15* (2006.01)
*B07B 13/00* (2006.01)

(58) Field of Classification Search
USPC ..... 209/659, 660, 667, 668, 671, 672, 673
See application file for complete search history.

(56) References Cited

U.S. PATENT DOCUMENTS 3,396,843 A * 8/1968 Allen ..... B65B 63/00
209/668
5,060,806 A * 10/1991 Savage ..... B07B 1/15
209/668
7,117,996 B1 * 10/2006 Mobley ..... A23N 15/00
209/667
8,875,902 B2 * 11/2014 Maile ..... B07B 1/14
209/673

FOREIGN PATENT DOCUMENTS

EP 2511014 A1 10/2012
GB 2407469 A 5/2005

* cited by examiner

RIDDLING DEVICE FOR RIDDLING MATERIALS AND RIDDLING BUCKET COMPRISING SAID DEVICE

CROSS-REFERENCE TO RELATED APPLICATIONS

This application is a § 371 national stage entry of International Application No. PCT/IB2014/000516 filed Apr. 8, 2014, which claims priority to Italian Application No. BO2013A000152 filed Apr. 8, 2013, both of which are hereby incorporated by reference in their entireties.

The present invention belongs to the field of treatment of inert or loose materials such as, for instance, recovered materials arising from demolitions, but also materials for the building industry such as, for instance, gravels, o even materials arising from excavations (earth) or the like.

In particular, the present invention belongs to the field of riddling materials of the kind mentioned above, such as materials arising from the demolition of solid issues or premises or even from excavations or gravels or the like. More in detail, the present invention relates to an apparatus or device for riddling said materials and separating components of different size. Still in more detail, the present invention relates to a riddling bucket equipped with said apparatus or device and adapted to be actuated by a main operating machine, said bucket being therefore in this case adapted to be applied to said operating machine, and for instance operatively connected to the dipper arm of an excavator.

STATE OF THE ART

It is known in general the need of treating inert materials arising from demolitions or excavations or similar operations so as to meet the requirements relating to the disposal of said materials. In particular, the need is known of riddling said inert materials so as to separate components of different size. In the same way, in the field of the building industry and/or road constructions, the need is known of riddling the inert materials such gravels or the like, still for the purpose of separating the components of different size.

In the state of the art different solutions are known for working and treating, in particular for riddling, inert materials arising from demolitions, excavations and similar operations, or even materials such as gravels or the like.

Among the most common solutions, those comprising essentially a bin or container are particularly widespread, wherein said bin is adapted to contain said materials and comprises a discharge aperture or exit for discharging parts of said materials (those subjected to riddling and which have passed through the riddling device and therefore have a size less than a predefined size), in correspondence of which there is disposed a riddling apparatus. In practice, by actuating said riddling apparatus, the smallest components pass through the riddling apparatus and are discharged through the discharge aperture, whilst the biggest components (with bigger size) remain inside the main bin and are discharged by overturning the bin.

In particular, riddling apparatuses are known which comprise a plurality of rollers or drums, each of said rollers or drums being equipped with a plurality or protruding tools such as teeth or blades, said rollers being arranged adjacent and parallel to each other, eventually in such a way that the tools of a given roller intersect those of the adjacent roller. By rotating the rollers or drums (in the same sense of rotation or even in different or alternated senses of rotation) a turbulence is generated in the material inside the bin so that its smallest components are allowed to pass through the spaces between two adjacent rollers and are discharged through the discharge aperture.

Obviously, the shape and reciprocal disposition of the tools may be modified according to the needs and/or circumstances.

The common solutions are however affected by several disadvantages which drastically decrease their versatility.

In particular, the main disadvantage of the apparatuses according to the prior art relates to the fact that the dimension or size of the riddled materials (which passes through the riddle or screen) may be selected and therefore adapted to the different exigencies and/or circumstances only by means of troublesome and difficult (and therefore time consuming and expensive, accordingly) operations. Actually, in the known riddling devices, the dimension and size of the interstices or interstitial spaces between the rollers or drums (through which those components with a size corresponding to or smaller than that of the interstitial spaces are allowed to pass, and which therefore define the size of the riddled materials) may be changed and/or modified only by replacing the tools of the rollers or varying the numbers of the tools (adding tools for decreasing the size of the riddled materials or removing tools for increasing same); accordingly, for the purpose of increasing the size of the components allowed to pass through the riddling apparatus the tools have to be replaced with, for instance, shorter tools and/or some of the tools (for instance one of two or the like) have to be removed.

It arises therefore from the above that the known solutions do not meet the most modern requirements (at least not adequately) according to which a riddling apparatus, even on the same working place or area or yard, and very often even during the same working day (perhaps several times within a short time) has to be able and adapted to treat different materials and to provide riddled materials of different sizes and dimension.

A further typical drawback of the known apparatuses arises in case of incidental block or stop of the riddling machine or apparatus, due for instance to a stone or hard component trapped between two adjacent rollers; in this case, if it reveals to be impossible to unblock the rollers by rotating same in two opposite senses of rotation so as to remove the stone and unblock the rollers (and the apparatus, accordingly), it is mandatory to remove and disassemble at least some of the rollers. This results however in the need to stop the riddle, with however working delays and corresponding costs, in particular both direct costs (arising from removing and assembling again the rollers) and indirect costs (arising from the stop of the riddle).

It is therefore an object of the present invention that of overcoming the above mentioned drawbacks affecting the prior art solutions. In particular, the objects and goals of the present invention may be summarized as follows.

Suggesting a solution allowing, by means of simple, quick and cheep operations, as well as adapted to be carried out by a unique operator, to modify the lay out or set up of the riddling apparatus (of its component parts) so as to be able to modify, according to the needs and/or circumstances, the size of the riddled materials. In particular, a further object of the present invention is that of suggesting a riddling apparatus, the lay out or set up of which may be modified according to easy and quick operations and eventually using the same source of power used for actuating (rotating) the rollers or drums, so as to modify the dimension and size of the interstitial spaces between two adjacent rollers (thus varying the size of the riddled materials, i.e. the materials discharged through the riddling apparatus), thus adapting same to the needs and/or circumstances, and without any need to remove or replace the tools fixed to the rollers. Still in more detail, a further object of the present invention is that of providing an apparatus, the set up of which may be modified in a simple and quick way, for instance for the purpose of removing an object trapped between two adjacent rollers and which caused the temporary stop of the apparatus.

The above objects and goals are obtained, according to the present invention, by means of an apparatus or device for riddling materials, for instance inert materials arising from demolitions and/or excavations or even materials for the building industry and for road constructions or works such as gravels or the like as claimed in main claim 1; further advantages are moreover obtained by means of the further embodiments of the present invention as defined in the dependent claims.

DESCRIPTION OF THE PRESENT INVENTION

The present invention is adapted to be conveniently used in the field of treatment of inert materials such as recovering materials, materials arising from demolitions and excavations but also materials such as gravels sands or the like. In particular, the present invention is adapted to be advantageously applied to machines such as, for instance, excavating machines or the like. In more detail, the present invention may be advantageously applied to a bucket adapted to be actuated by a main operating machine, for instance an excavating machine for building works or the like. This is therefore the reason why, in the following, examples will be described in which the present invention is applied to a bucket for excavators or the like for treating materials in general. It has however to be noted that the possible uses and/or applications of the present invention are not limited to the case of riddling buckets for excavating machines. To the contrary, the present invention may be conveniently applied even to different apparatuses, for instance fixed apparatuses for yards or the like, as well as for treating different materials.

The present invention is based on the general consideration that the disadvantages and/or problems affecting the solutions according to the prior art may be overcome by providing a device for riddling materials the lay out or set up of which may be modified in an essentially simple way or even in an automatic way. A further consideration on which the present invention is based is that the drawbacks of the solutions according to the prior art may be overcome by means of a solution allowing to modify the reciprocal set up, in particular the distance between the axis of rotation at least two adjacent riddling rollers.

In fact, in this way, the interstitial spaces between two adjacent rollers may be modified depending on the size of the materials to be riddled, thus defining the size of the riddle materials as well. Moreover, in case of an incidental block or stop of the apparatus due for example to a solid object (stone or the like) trapped between two adjacent rollers, it will be possible to unblock said object and remove same, simply by increasing the inter axial distance between said two rollers, thus moving same away from each other. A further consideration on which the present invention is based relates to the fact that further advantages may be obtained by means of a solution allowing to modify the reciprocal set up of the rollers by using a source of power already at disposal, for instance the hydraulic main system used both for actuating the bucket and for actuating the riddling apparatus (for rotating the rollers or drums).

On the basis of the above considerations, an object of the present invention is a device as claimed in claim 1 namely a riddling device for riddling materials such as for instance aggregates or the like by separating components of different size, said device comprising a main bin adapted to contain said materials, with a discharging aperture for discharging during riddling components of a predefined size, a riddling system disposed substantially in correspondence of said discharging aperture and comprising a first and a second riddling rollers rotatable on respective rotation axis substantially parallel and adjacent to each other, said system comprising means adapted to modify the reciprocal distance between said two axis of rotation of said first and second riddling rollers, respectively.

According to a further embodiment the axis of rotation of said first riddling roller is adapted to be translated along a first circumferential arch lying on a plane substantially perpendicular to said axis of rotation of said first riddling roller so that the translation of the axis of rotation of said first riddling roller along said first circumferential arch results in a variation of the reciprocal distance between said two axis of rotation of said first and second riddling rollers, respectively.

According to a further embodiment said first riddling roller is rotatably supported by a first and a second supporting plates opposite to each other and disposed along its axis of rotation, said first and second plates being rotatable on a first common axis of rotation, the axis of rotation of said first riddling roller being eccentric with respect to said first common axis of rotation of said first and second supporting plates so that the rotation of said first and second plates on said first common axis of rotation results in said axis of rotation of said first riddling roller being translated along said first circumferential arch.

Advantageously, said means adapted to modify the reciprocal distance between said axis of rotation of said first and second riddling rollers, respectively, are adapted to rotate said first and second supporting plates on said first common axis of rotation.

According to a further embodiment each of said first and second supporting plates comprises a portion engaged by first and second thrust means, respectively, said thrust means being translatable along a rectilinear path alternatively in two opposite directions of translation so that the translation in a direction of translation of said first and second thrust means results in said first and second supporting plates being rotated in a first direction of rotation, whilst the translation in the opposite direction of translation of said first and second thrust means results in said first and second supporting plates being rotated in a second direction of rotation opposite to said first direction of rotation.

According to a further embodiment said second riddling roller is rotated by means of a power source, and said first riddling roller is rotatably driven by means of said second riddling roller through a driving transmission.

Advantageously, said driving transmission is of the kind comprising either a belt or a chain, and a first deviating idle or neutral pinion gear is disposed along the path of said driving transmission so as to adapt the path of said transmission to the distance between the axis of rotation of said rollers or drums.

Still advantageously, said first idle or neutral pinion gear is fixed to said second plate rotatably on a own axis of rotation eccentric with respect to said first common axis of rotation and different from said axis of rotation of said first riddling roller.

According to a further embodiment said device further comprises a third riddling roller rotatable on a own axis of rotation parallel and adjacent to said axis of rotation of said second riddling roller, and said device comprises means adapted to modify the reciprocal distance between said two axis of rotation of said third and second riddling rollers, respectively.

According to still a further embodiment the axis of rotation of said third riddling roller is adapted to be translated along a second circumferential arch lying on a plane substantially perpendicular to said axis of rotation of said third riddling roller so that the translation of the axis of rotation of said third riddling roller along said second circumferential arch results in a variation of the reciprocal distance between said two axis of rotation of said third and second riddling rollers, respectively.

Advantageously, said third riddling roller is rotatably supported by a third and a fourth supporting plates opposite to each other and disposed along its axis of rotation, said third and fourth plates being rotatable on a second common axis of rotation, the axis of rotation of said third riddling roller being eccentric with respect to said second common axis of rotation of said third and fourth supporting plates so that the rotation of said third and fourth plates on said second common axis of rotation results in said axis of rotation of said third riddling roller being translated along said second circumferential arch.

Still advantageously, each of said third and fourth supporting plates comprises a portion engaged by said first and second thrust means, respectively, so that the translation in a direction of translation of said first and second thrust means results in said third and fourth supporting plates being rotated in a first direction of rotation, whilst the translation in the opposite direction of translation of said first and second thrust means results in said third and fourth supporting plates being rotated in a second direction of rotation opposite to said first direction of rotation.

According to a further embodiment said third riddling roller is rotatably driven by said second riddling roller through a second transmission.

Advantageously, said second transmission is of the kind comprising a chain or a belt, and a second deviating idle or neutral pinion gear is disposed along the path of said second transmission so as to adapt the path of the transmission to the distance between the axis of rotation of the rollers.

Still advantageously, said second idle or neutral pinion gear is fixed to said fourth plate rotatably on a own axis of rotation, eccentric with respect to said second common axis of rotation and different from said axis of rotation of said third riddling roller.

The present invention furthermore relates to a riddling bucket for riddling inert materials said bucket being equipped with a riddling device.

Further advantages will moreover be obtained by means of the further embodiments of the apparatus according to the present invention as defined in the dependent claims and/or described in the following,

BRIEF DESCRIPTION OF THE DRAWINGS

In the following, the present invention will be clarified by means of the description of some embodiments depicted in the drawings. It has however to be noted that the present invention is not limited to the embodiments depicted in the drawings; to the contrary, all those modifications of the embodiments depicted in the drawings and described in the following which will appear to be clear and obvious to those skilled in the art fall within the scope of the present invention. In particular, in the drawings.

DETAILED DESCRIPTION OF SOME EMBODIMENTS OF THE PRESENT INVENTION

Figure 1:
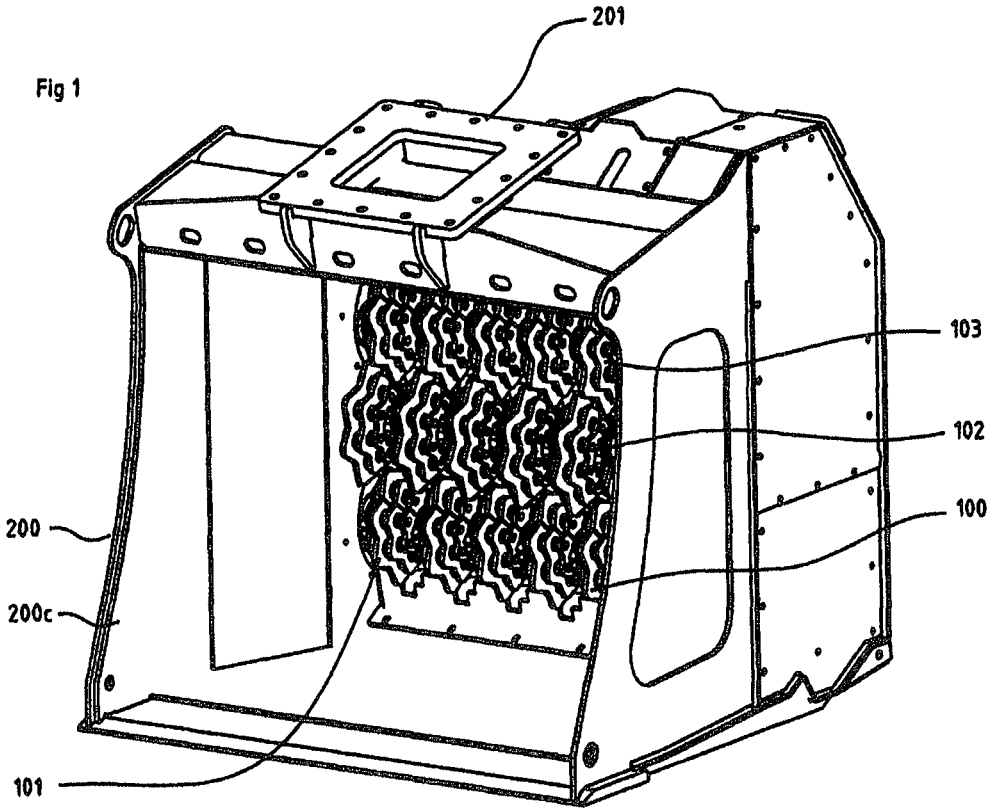
FIG. 1 shows a front prospective view and a rear prospective view of a riddling device according to the present invention.
Figure 1:
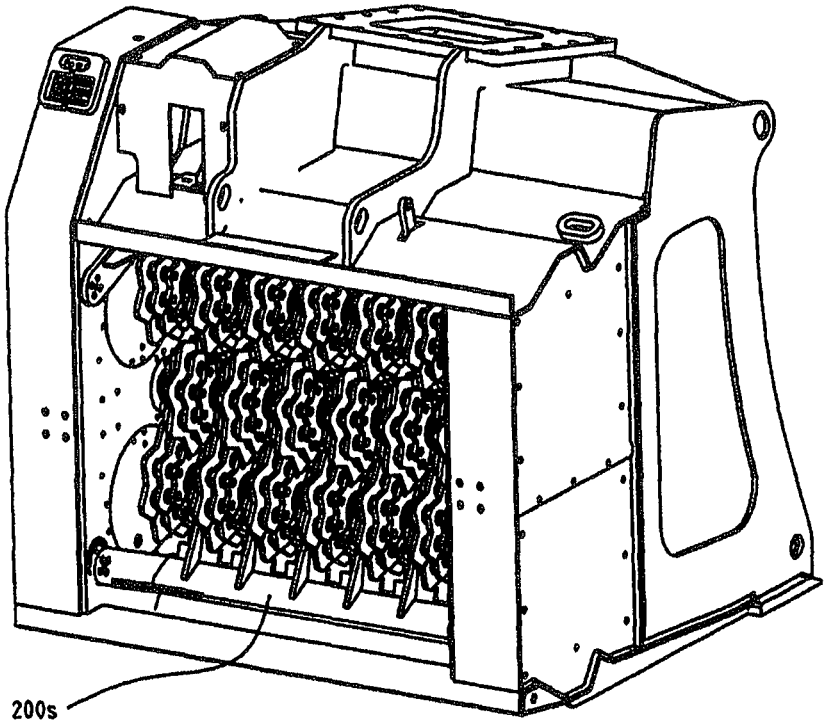
Figure 2A:
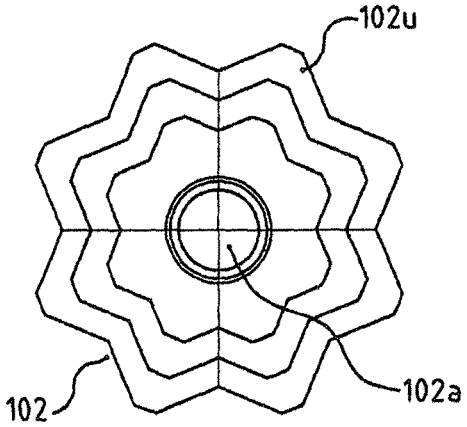
FIGS. 2*a* and 2*b*, 3*a* and 3*b* and 4*a* and 4*b* show sectional and lateral views of component parts or portions of same of the device according to the present invention.
Figure 2B:
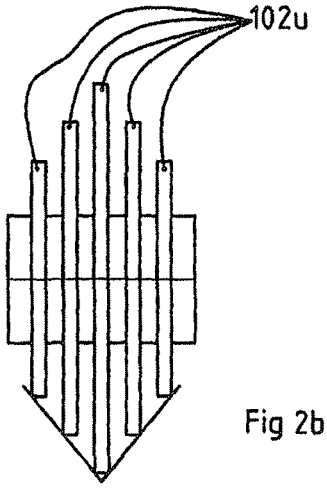
Figure 3A:
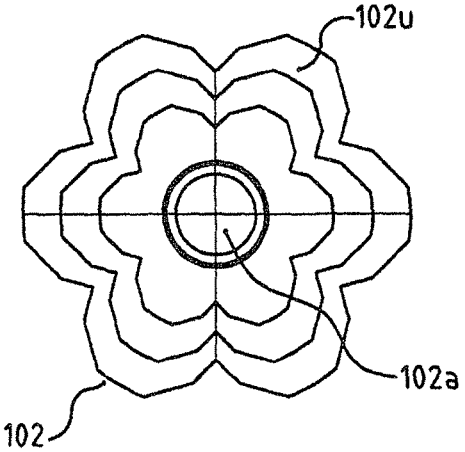
Figure 3B:
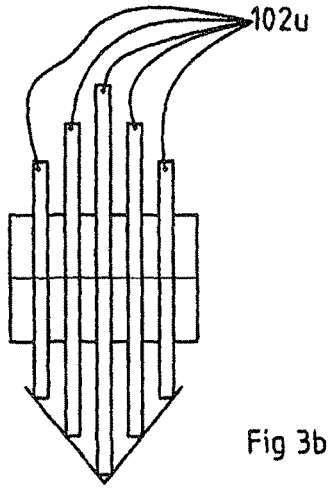
Figure 4A:
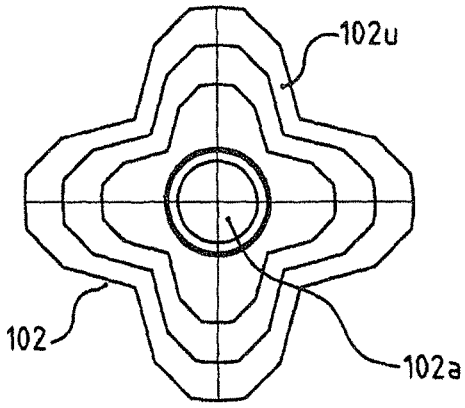
Figure 4B:
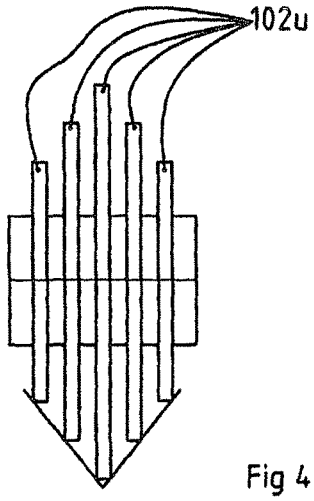

In FIG. 1, reference 200 identifies a bucket adapted to be actuated by a main operating machine, for instance an excavating machine equipped with a dipper working arm (articulated and rotatable); to this end, the bucket 200 comprises means 201 for fixing the bucket to the end portion of the dipper arm of the main operating machine. Said fixing means 201 are adapted to allow the bucket 200 to be moved in the tridimensional space; since said means, as such, are known to those skilled in the art, a detailed description of same is omitted for the sake of conciseness. In the same way, the bucket 200 comprises connecting links for allowing the bucket 200 to be connected to a main source of power, for instance the hydraulic system of an operating machine; a detailed description of both said links and hydraulic system is omitted as well, still for the sale of conciseness. The bucket 200 is to be used for riddling materials, for instance inert materials such as recovering materials (arising from demolitions and/or excavations and/or similar operations), but also materials for the building industry or road constructions such as gravels, sands or similar materials. To this end, the bucket comprises a main bin with a loading aperture 200*c* through which the materials may be introduced or loaded into the main bin, and a discharge opening or aperture 200*s* through which those components of the materials previously loaded into the main bin which passes through the riddle of riddling apparatus (also referred to as riddled products or riddled materials) are discharged. Off course, in the case in which the bucket 200 is applied to the dipper arm of a main operating machine, the materials will be loaded into the main bin by actuating the bucket by means of the arm of the main operating machine according to the usual operations of a bucket.

In correspondence of the discharge aperture or opening 200*s* there is disposed a riddling device 100 which, in the case of the embodiment depicted in FIG. 1, comprises three rotatable rollers or drums, in particular a first drum 103, a second (intermediate) drum and a third roller or drum 101. The rollers or drums 103, 102 and 101 are adapted to be rotated each on its own longitudinal axis of symmetry, the corresponding axis of rotation being accordingly substantially parallel and adjacent to each other in correspondence of the discharge opening or aperture 200*s*. Whilst the features and functioning procedures of the riddling device 100 will be described later, it is already possible to appreciate that, by rotating simultaneously the three riddling rollers 103, 102 and 101 (of course with the bucket 200 positioned with the loading aperture 200*c* facing up and the discharge aperture 200*s* facing down) the materials inside of the bucket 200 are agitated (meaning that they are agitated with turbulence) so that the components of said materials with size corresponding to or smaller than a predefined size pass through the riddling drums, whilst the components with bigger size are kept inside the main bin of the bucket 200.

Figure 5A:
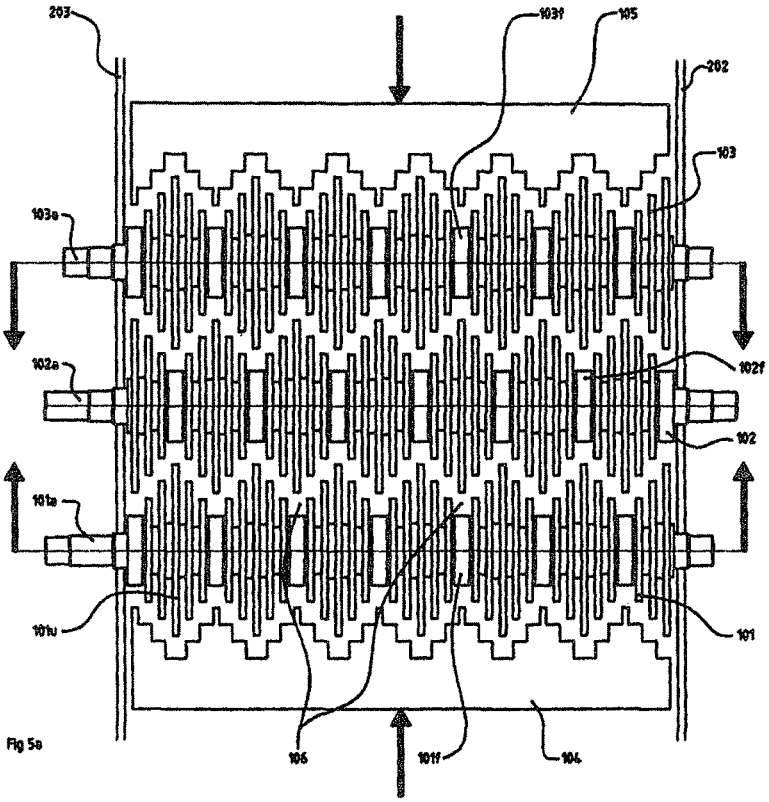
FIGS. 5*a* and 5*b* and 6*a* and 6*b* show a top view and a side view of the device according to the present invention in two different set ups or lay outs, respectively.
Figure 5B:
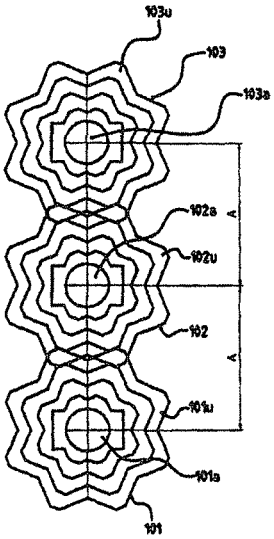

With reference to FIGS. 2*a*, 2*b*, 3*a*, 3*b*, 4*a* and 4*b*, as well as to FIGS. 5*a* and 5*b*, both the conformation of the riddling rollers and their reciprocal disposition may be appreciated. In particular, with reference to FIG. 5*e*, one can appreciate that, on each of the riddling rollers 103, 102 and 101, there are fixed tools (103*u*, 102*u* and 101*u*, respectively, disposed side by side and along each roller so as to define interstitial spaces both between two adjacent tools of the same roller and between tools of two adjacent rollers, through which the components of the materials with size substantially smaller than the dimensions of said interstitial spaces are discharged through the discharge aperture 200*s* of the main bin of the bucket 200. In particular, the tools 103*u* of the roller 103 are divided in groups of 5 tools (or of three tools at the end portions of the roller), and the tools of a group extend from the external surface of a corresponding fixing or distancing element 103*f*, said fixing or distancing elements 103*f* being in turned fixed to the shaft of rotation of the roller 103*e*. In the same why, the tools 102*u* of the roller 102 are divided in groups of 5 tools (of three tools at the end portions of the roller) and the tools of a group extend from the external surface of a corresponding fixing or distancing element 102*f*, said fixing or distancing elements 102*f* being fixed to the rotational shaft of said roller 102. Still in the same way, the tools 101*u* of the roller 101 are divided in groups of 5 tools (or of 3 tools at the end portions of the roller), and the tools of a group extend from the external surface of a distancing or fixing element 101*f*, said fixing or distancing elements 101*f* being fixed to the rotational shaft of the roller 101. In particular, the tools are preassembled in groups of a predefined number (5 in the particular case depicted in the drawings, but the number may change according to the needs or circumstances) on said fixing elements 101*f*, 102*f*, 103*f*, wherein each of same comprises a tubular empty seat, wherein there is disposed a portion of a rotational shaft.

A second feature of the riddling device according to the present invention as depicted in the drawings relates to the shape and dimension of the tools. These may in fact have different shapes such as, for instance, those represented in the figures from 2*a* to 4*a*, meaning the shape substantially of a plate with an external edge shaped like a stern with a variable number of tips or end portions. Moreover, the external dimension of the tools or plates vary as represented in the drawings from 2*b* to 4*b*; that means that, considering a predefined number of tools (5 in the drawings) fixed to a single distancing element 101*f*, 102*f*, 103*f*, the radius of an hypothetical circumference common to the end portions of a tool will vary depending on the disposition or position of the tool along the fixing or distancing element 101*f*, 102*f*, 103*f*, in particular from a minimum radius in correspondence of the most external tools, wherein said radius increases progressively until the central tool. In other words, the tools of a distancing element are received in a space or volume having the shape of a pinecone. Moreover, the external dimensions of the tools are repeated periodically along the same roller, meaning that the tools of a roller are received inside of a volume formed by frustoconical subsequent volumes so that a longitudinal section of said volume is delimited by two opposite sinusoidal curves. This solution allows to optimize the movement of the materials inside the bin and therefore of speeding up the riddling operations. In fact, since the angular speed (given by the angular speed of the rotational shaft of the roller) is common to all the tools of a roller, the peripheral speed (tangential speed) of the end portions of those tools which are located on an hypothetical circumference of shorter radius (for instance that of the end portions of the two most external tools) will be less than the peripheral velocity or speed of the end portions of a tool which are located on an hypothetical circumference of longer radius (for instance those of the center tool in the drawings). In this way, the impact of the end portions of the tools with bigger dimensions (radius) on the materials inside the bin will be more than the impact on the same materials of the end portions of tools of smaller dimensions (radius), thus conferring to the materials an improved general turbulence which allows the materials to be discharged (those which pass through the interstitial spaces) through the riddling device and the discharge aperture of the main bin of the bucket, accordingly. Moreover, the riddling operation are improved (speeded up) also due to the reciprocal disposition of the tools of two opposite rollers; in fact, as depicted in the drawings, in correspondence for instance of a tool of minimum radius of the roller 203 there is disposed a tool of intermediate or maximum radius of the roller 102 and so on along the longitudinal development of the rollers. The same applies of course to the rollers 102 and 101. Also this solution allows to increase the turbulences conferred by the rollers to the material and accordingly to speed up the riddling operation. Of course, depending on the needs and/or circumstances, the shape of the "pinecones" can be changed and it will be possible even to use different "pinecones", eventually also on the same roller.

In the FIGS. 5*a*, 5*b*, and 6*a* and 6*b* the component parts or features of the riddling device according to the present embodiment of the present invention depicted therein and already described with reference to other figures are identified by the same reference numerals. Moreover, in FIGS. 5*a*, 5*b*, 6*a* and 6*b* there are depicted a first lateral scraping element 105 and a second lateral scraping element 104. The first scraping element 105 has an internal profile (facing the inside of the bin) which follows the profile of the tools 103*u* of the first riddling roller 103 and is disposed on the side of said first riddling roller 103 opposite with respect to the second (intermediate) riddling roller 102. In the same way, the second scraping element 104 has an internal profile (facing the inside of the bin) which follows the profile of the third riddling roller 101 and is disposed on the side of said third riddling roller 101 opposite with respect to the second intermediate riddling roller 102.

Said first and second scraping elements 104 and 105 are used for defining in combination respectively with the first and third riddling roller 103 and 101 interstitial spaces with shape and dimensions corresponding substantially to the interstitial spaces defined by two adjacent rollers, in particular both by the first roller 103 in combination with the second roller 102 and by the second roller 102 in combination with the third roller 101. It arises moreover from the drawings that the riddling rollers 103, 102 and 101, as well as the two scraping elements 105 and 104 are disposed between two opposite lateral walls 103 and 102 of the main bin of the bucket.

A further very important feature of the riddling device 100 may be moreover appreciated with reference to the drawings which show the device 100 according to different working setups. In particular, a first working setup depicted in the FIGS. 5*a* and 5*b* is the so called "completely open" setup, wherein the interstitial spaces between both adjacent rollers and the scraping devices and the corresponding rollers have their maximal dimensions and the tools of two adjacent rollers overlap only less according to a side view as depicted in FIG. 5*b*. In particular, with this setup, the distance between the rotational axis of two adjacent rollers, and therefore between the rollers 103 and 102 and between the rollers 102 and 101 as well as the distance between the rotational axis of the roller 103 and the scraping element 105 and the distance between the rotational axis of the roller 101 and the scraping element 104 is the maximal possible distance. In this setup, the size of the components of the riddle materials (passing through the riddling device) will be the biggest possible size. According to the present invention, the distance between the rotational axis of two adjacent rollers, as well as the distance between the first and second scraping elements 105 and 104 and the corresponding riddling rollers (the riddling roller 103 for the first scraping element 105 and the riddling roller 101 for the second scraping element 104, respectively), may be changed as indicated by the arrows in the drawings.

Figure 6A:
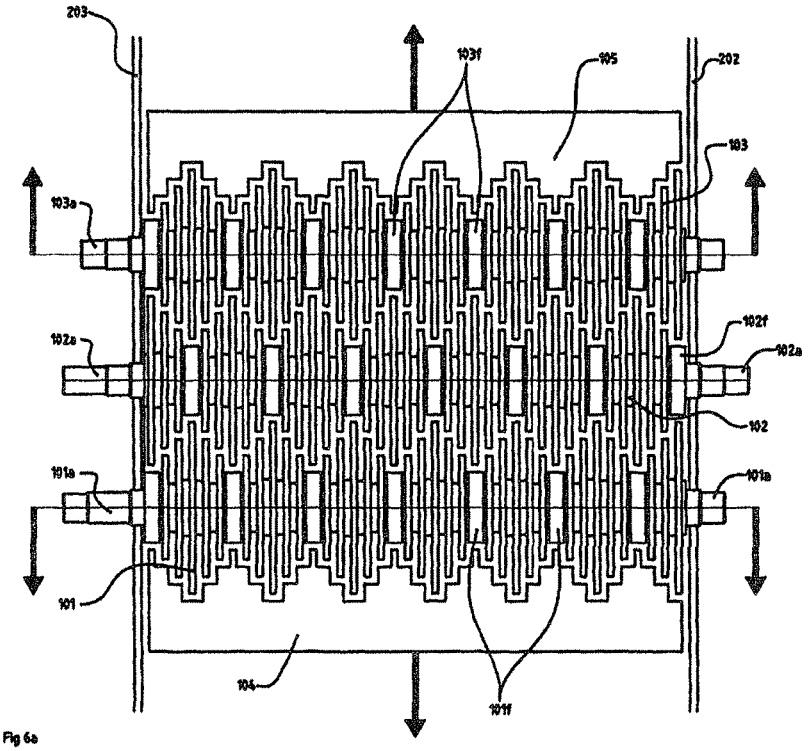
Figure 6B:
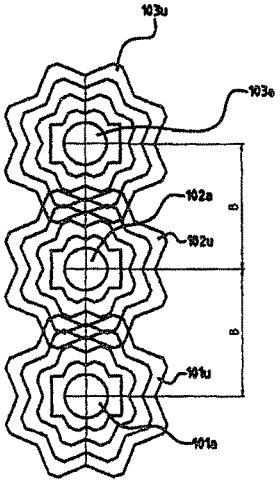

In particular, FIGS. 6*a* and 6*b* show the riddling device in the so called "completely closed" setup in which the distance between the rotational axis of two adjacent rollers, as well as the distance between each of the scraping elements 105 and 106 and the rotational axis of the corresponding adjacent rollers is the shortest possible distance. In this setup, as depicted in FIG. 6*b*, the tools of two adjacent rollers overlap at the most according to a lateral view. Moreover, the dimension or size of the interstitial spaces between adjacent rollers as well as between the scraping elements and the adjacent rollers is the shortest possible distance so that the size of the riddled materials (which may pass through said interstitial spaces and therefore may be discharged through the riddling device) will be the smallest possible size.

It has therefore been clarified that in the riddling device according to the present invention the setup or the reciprocal disposition of the riddling rollers as well as of the scraping element may be changed, so that the size of the riddled material may be changed depending on the needs or circumstances; in particular, the distance between the axis of rotations of two adjacent rollers may be changed as well as the distance between each of the scraping elements and the corresponding adjacent roller. In detail, the riddling rollers 103, 102 and 101, as well as the two external scraping element 105 and 104 are allowed to take a predefined intermediate position between the two extreme positions "completely open" of FIG. 6*e* and "completely closed" of FIG. 6*b*.

In the following, with the reference to FIGS. 7*a*, 7*b*, 7*c* and 7*d* those solutions and procedures according to the present invention will be clarified, by means of which it is possible to modify the setup of the riddling device, in particular the distance between the rotational axis of two adjacent rollers, as well as the distance between each of the scraping elements 105 and 104 and the adjacent riddling roller; of course, in FIGS. 7*a*, 7*b*, 7*c*, and 7*d* those component parts or features of the present invention which have already been described with reference to other figures are identified by the same reference numerals.

The figures show how each of the riddling rollers 103, 102 and 101 is rotatably disposed between the two lateral opposite walls 202 and 203 of the main bin. In particular, the opposite end portions of the rotational shaft 102*a* of the second (central) roller 102 are rotatably received in corresponding seats of said opposite lateral walls 202 and 203, respectively. The rotational shaft 103*a* of the first riddling roller 103, to the contrary, is rotatably supported by two opposite support plates 110, which are in turn rotatably received in corresponding seats formed respectively in the lateral walls 202 and 203 of the main bin. In particular, a first support plate 110 is rotatably received in the lateral wall 103, whilst the second support plate 110 is rotatably received in the opposite lateral wall 202. To this end, each of the two support plates 110 comprises at disk shaped portion 110*d* rotatably received in a seat of corresponding (circular) shape of the lateral wall. Accordingly, the two first and second plates 110 are allowed to rotate on a first common axis of rotation C1 which extends between the centers of the two disk shaped portions 110*b* of the first and second support plates 110. As to the rotational shaft 103*a* of the first riddling roller 103, a first end portion of said rotational shaft 103*a* is rotatably received in a corresponding seat of the first supporting plate 110, whilst the second end portion of said rotational shaft 103*a* opposite to the first end portion is rotatably received in a seat of the second support plate 110 opposite to the first support plate 110. It has to be noted that the rotational axis of the first rotational shaft 103*a* of the first riddling roller 103 does not correspond to the common rotational shaft C1 of the first and second support plates 110; to the contrary, the rotational axis of the rotational shaft 103*a* is eccentric with respect to said first common rotational axis C1 of said first and second support plates. The above also applies to the third riddling roller 101 and the corresponding support plates. In fact, a third support plate 120 is rotatably received in the lateral wall 203, whilst a fourth support plate 120 is rotatably received in the lateral wall 202 opposite to said lateral wall 103. To this end, each of the two support plates third and fourth 120 comprises a disk shaped portion 120*d* rotataby received in a seat of corresponding shape (circular) of the lateral wall. Accordingly, the two plates third and fourth 120 are allowed to rotate on a second common axis of rotation C2 which extends between the centers of the two disk shaped portions 120*d* of the third and fourth support plates 120. As to the rotation shaft 101*a* of the third riddling roller 101, a first end portion of said rotational shaft 101*a* is rotataby received in a corresponding seat of the third support plate 120, whilst the second end portion of said rotational shaft 101*a* opposite to the first end portion is rotataby received in a convenient seat of the fourth support plate 120 opposite to the first support plate 120. It has to be noted that, also in this case, the rotational axis of the third rotational shaft 101*a* of the third riddling roller 101 does not correspond to the common rotational axis C2 of the third and fourth support plates 120; to the contrary, the rotational axis of the rotational shaft 101*a* is eccentric with respect to said second common rotational axis C2 of said third and fourth support plates.

Figure 7A:
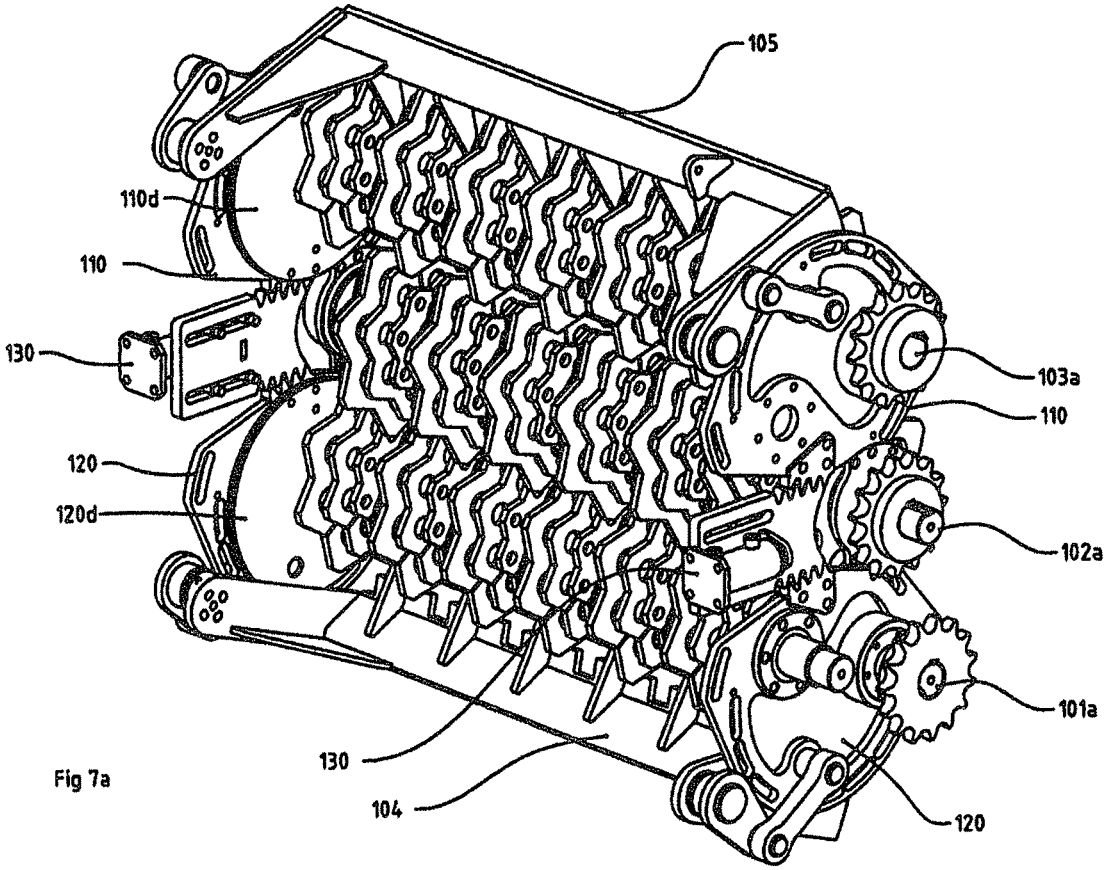
FIGS. 7*a*, 7*b*, 7*c* and 7*d* show a prospective view, a top view and two side views, respectively, of the device according to the present invention in a first working set up.
Figure 7B:
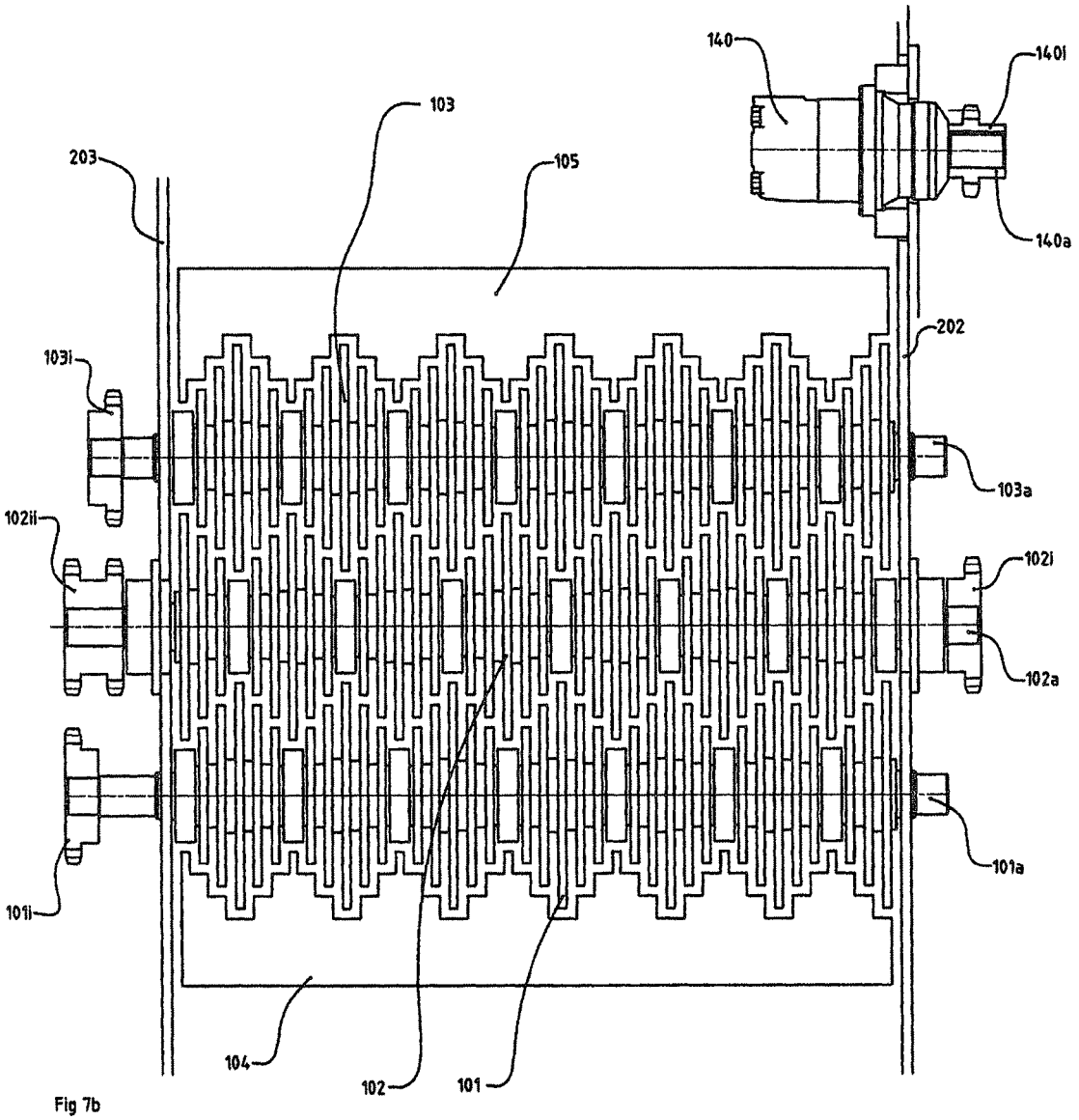
Figure 7C:
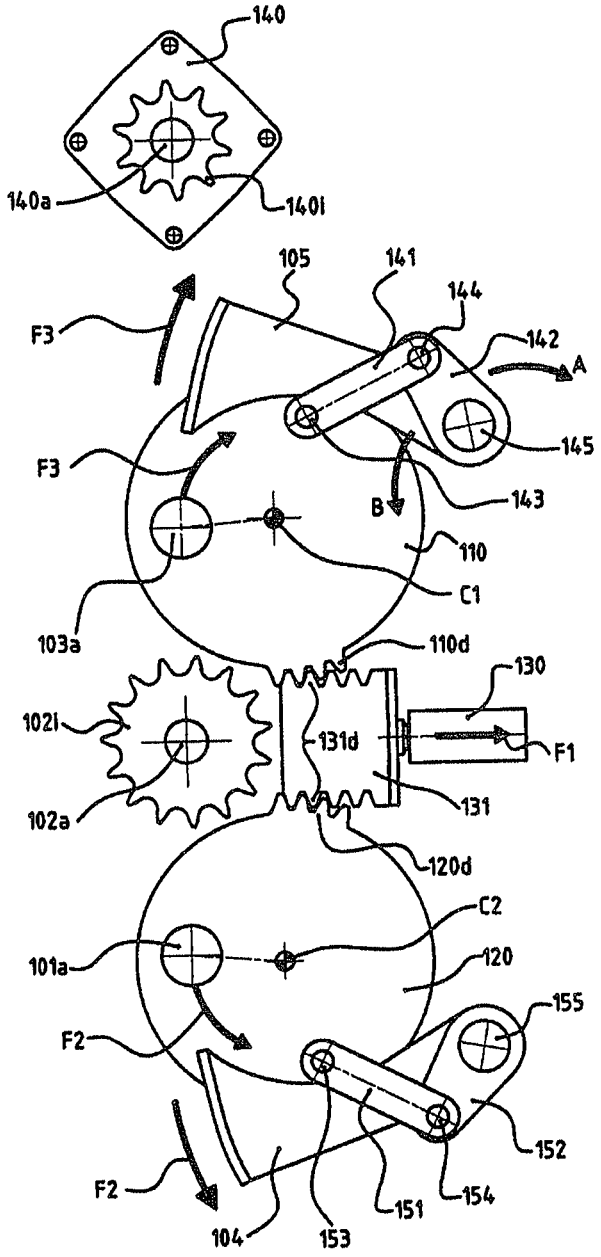

It arises therefore from the drawings as well as taking into account the above disclosure that, by rotating the two support plates 110 on their common axis of rotation C1 in the direction of rotation indicated by the arrow F3 in FIG. 7*c*, the rotational axis of the rotational shaft 103*a* of the first riddling roller 103 will be rotated in the same direction of rotation so that it will be translated along an arch of circumference perpendicularly to said axis of rotation of the shaft 103*a* so that the distance between the axis of rotation of the rotational shaft 103*a* of the first riddling roller 103 and the axis of rotation of the rotational shaft 102*a* of the second riddling roller 102 will increase, so that also the dimension of the interstitial spaces defined in combination by the tools 103*u* and 102*u* of said first and second riddling rollers 103 and 102, respectively, will also increase. In the same way, by rotating the two support plates 120 on their common axis of rotation C2 in the direction of rotation indicated by the arrow F2 in FIG. 7*c*, the axis of rotation of the rotational shaft 101*a* of the third riddling roller 101 will be rotated in the same direction of rotation so that it will be translated along an arch of circumference perpendicularly to said axis of rotation of the shaft 101*a*, so that the distance between the axis of rotation of the rotational shaft 101*a* of the third riddling roller 101 and the axis of rotation of the rotational shaft 102*a* of the second riddling roller 102 will increase, so that also the dimension of the interstitial spaces defined in combination by the tools 101*f*, 102*f* of said third and second riddling rollers 101 and 102, respectively, will also increase.

Of course, by rotating the support plates according to directions of rotation opposite to those just described above, respectively, the opposite result will be achieved. In particular by rotating the support plates 110 on their common axis of rotation C1 in the direction of rotation opposite to that indicated by the arrow F3, the distance between the axis of rotations respectively of the rotational shafts 103*a* (of the first riddling roller 103) and 102*a* (of the second riddling roller 102) will be reduced, whilst rotating the support plates 120 on their own common axis of rotation C2 in a direction of rotation opposite to that indicated by the arrow F2 in FIG. 7*c*, the distance between the axis of rotation of the rotational shafts 101*a* (of the third riddling roller 101) and 102*a* (of the second riddling roller 102), respectively will also be reduced.

The figures show moreover the solution adopted according to the embodiment of the present invention depicted therein for rotating simultaneously said first and second support plates 110 and said third and fourth support plates 120. To this end, it has to be noted that each of the support plates comprises a toothed peripheral portion. The toothed portions 110*b* and 120*d* of the first support plate 110 and the third support plate 120 are engaged by opposite toothed portions 131*d* of first right thrust means (on the right in FIG. 7*b*) 131. In the same way, the toothed portions 110*d* and 120*d* of the second support plate 110 and the first support plate 120 are engaged by opposite toothed portions 131*d* of second left thrust means (on the left in FIG. 7*b*) 131. Said first and second left and right thrust means 131 are simultaneously translated alternatively along two opposite directions of translation as indicated by the double arrows F1. A translation of the right and left thrust means 131 along a first direction of translation, due to the reciprocal engagement of the toothed portions 131*d*, 110*d* and 120*d*, results in a simultaneous rotation of the first and second support plates 110 and of the third and fourth support plates 120 in the direction of rotation indicated respectively by the arrows F3 and F2 with the mechanical results described above as to the modification of the reciprocal setup of the riddling rollers. In the same way, a translation of the thrust means 131 along the opposite direction of translation results, still due to the reciprocal engagement of the toothed portions 131*d*, 110*d* and 120*d*, in a simultaneous rotation of the first and second support plates 110 and the third and fourth support plates 120 in directions of rotations opposite to those indicted by the arrows F3 and F2 in FIG. 7*c*, respectively, also in this case thus generating the mechanical results described above as to the variation of the reciprocal disposition of the riddling drums or rollers.

By way of none limiting example, the thrust means 131 disposed on opposite sides of the bin may be activated and translated accordingly, by means of corresponding right and left hydraulic pistons 130, for instance connected to the main hydraulic system of an operating machine. It has however to be noted that the solution just described above and depicted in the drawings for rotating the support plates is not the only possible solution which may be adopted to this end. For example, depending on the needs and/or circumstances, the toothed portions of the plates and/or the thrust means 131 (with the opposite toothed portions 131*d*) could be conveniently substituted by a system comprising levers and connecting rods.

Still with reference to the drawings it is possible to appreciate that in the device according to the embodiment of the present invention depicted therein, simultaneously with the setup of the first riddling roller 103 and third riddling roller 101 with respect to the central or intermediate second riddling roller 102 as described above, also the setup of the two scraping elements 105 and 104 is obtained. In fact, the first scraping element 105 is rotatably fixed to the first support plate 110 by means of a first right lever system (on the right in FIG. 7*a* and depicted in FIG. 7*c*) and to the second support plate 110 by means of a second left lever system (on the left in FIG. 7*a* and depicted in FIG. 7*d*) totally similar to the first one. In the same way, the second scraping element 104 is fixed to the third support plate 120 by means of a third, right lever system (on the right of FIG. 7*a* and depicted in FIG. 7*c*) and to the fourth support plate 120 by means of a fourth left lever system (on the left of FIG. 7*a* and depicted in FIG. 7*d*) totally similar to the third system. Being therefore the component parts and actuating procedures of the first and second lever systems (right and left) totally similar to those of the third and fourth systems, description will be given, in the following for the sake of conciseness, solely of the first and second lever systems and their actuating procedures.

A first right lever 141 is fixed to the first support plate 110 rotatably on a axis of rotation 143; a first corresponding left lever 141 is fixed to the second support plate 110, also rotatably on said axis of rotation 143. The axis of rotation 143 is moreover eccentric both with respect to the first common axis of rotation C1 and with respect to the axis of rotation of the first riddling roller 103. A second right lever 142 is fixed to the first right lever 141 rotatably on an axis of rotation 144 and a second corresponding left lever 142 is fixed to the first left lever 141 rotatably on said axis of rotation 144; moreover, the opposite end portion respectively of the second right lever 142 and the second left lever 142 is rotatably fixed to a rotational shaft 145. Finally, the end portion of the scraping element 105 opposite to the end portion on which there are disposed the scraping tools is also rotatably fixed to the rotational shaft 145. It results therefore that a rotation of the first and second support plates 110 in the direction of rotation indicated by the arrow F3 results in a rotation of the axis of rotation 143 along the same direction of rotation, and therefore in a rotation of the second left and right levers 142 in the direction indicated by the arrow A so that the end portion of the scraping element 105 which supports the scraping tools (the end portion opposite to the rotational shaft 145), will be rotated in the direction of rotation indicated by the arrow F2. Of course, a rotation of the first and second support plates 110 in the direction of rotation opposite to that indicated by the arrow F3 results in a rotation of the axis of rotation 143 in the same direction of rotation, and therefore in a rotation of the second right and left levers 142 in the direction of rotation indicated by the arrow B so that the end portion of the scraping element 105 which supports the scraping tools will be rotated in the direction of rotation opposite to the direction of rotation indicated by the arrow F3. It has therefore been clarified that a rotation of the first and second support plates 110 so as to increase the distance between the axis of rotation of the first riddling roller 103 and the second riddling roller 102 will result in the distance between the first scraping element 105 and the first riddling roller being increased; to the contrary, a rotation of the first and second support plates 110 so as to decrease the distance between the axis of rotation respectively of the first riddling roller 103 and the second riddling roller 102 will result in the distance between the first scraping element 105 and the first riddling roller 103 being decreased. Of course the variation of the distance between the first scraping element 105 and the axis of rotation of the rotational shaft 102*a* (of the second intermediate roller 102) will be double the variation of the distance between the axis of rotation of the shafts 103*a* and 102*a* respectively of the first roller 103 and the second roller 102 for "recovering" said variation of the reciprocal distance, since the variation of the distance between the first scraping element 105 and the axis of rotation of the rotational shaft 102*a* (of the second intermediate roller 102), which is simultaneous and obtained by means of a variation of the distance between the axis of rotation of the shafts 103*a* and 102*a* respectively of the first roller 103 and the second roller 102. In the same way, a rotation of the third and fourth support plates 110 such as to increase the distance between the axis of rotation of the third riddling roller 101 and the second riddling roller 102 will result in the distance between the second scraping element 104 and the third riddling roller 101 being also increased; to the contrary, a rotation of the third and fourth support plates 120 such as to decrease the distance between the axis of rotation respectively of the third riddling roller 101 and the second riddling roller 102 will result in the reciprocal distance between the scraping element 104 and the third riddling roller 101 being decreased. Of course, also in this case, the variation of the distance between the second scraping element 104 and the axis of rotation of the rotational shaft 102*a* (of the second intermediate roller 102) will be doubled the variation of the distance between the axis of rotation of the shafts 101*a* and 102*a* respectively of the third roller 101 and the second roller 102 for "recovering" said variation of the reciprocal distance.

It has finally to be highlighted how the simultaneous movement of the first riddling roller 103 and the third riddling roller 101, as well as of the first scraping element 105 and the second scraping element 104 is obtained by means of the left and right thrust means 131.

It has moreover to be specified that, between the support plates 110 and 120 (between their disk shaped portions) and their corresponding seats formed in the lateral walls 202 and 203, there are interposed sealing means (not depicted in the drawings) for the purpose of avoiding material entering between the moving parts, which could represent an obstacle for the reciprocal movement. In this way, periodical cleaning and maintenance operation may be avoided which to the contrary would be needed in case of infiltrations of material. In particular, said infiltrations of materials could not be avoided in the case in which the set up of the reciprocal position of the rollers and scraping elements would be obtained by means of solutions according to which the rotational shaft would be translated for instance inside of receiving holes or the like. The solution adopted according to the present invention and described above has therefore to be appreciated as a particularly advantageous aspect of the present invention.

Figure 7D:
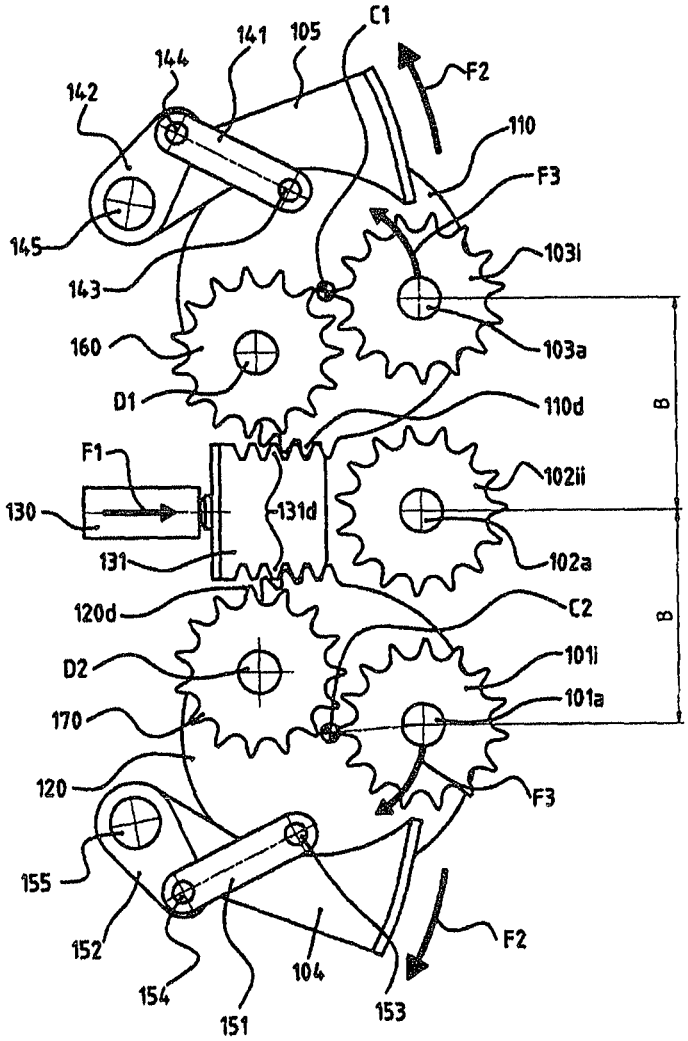
Figure 8A:
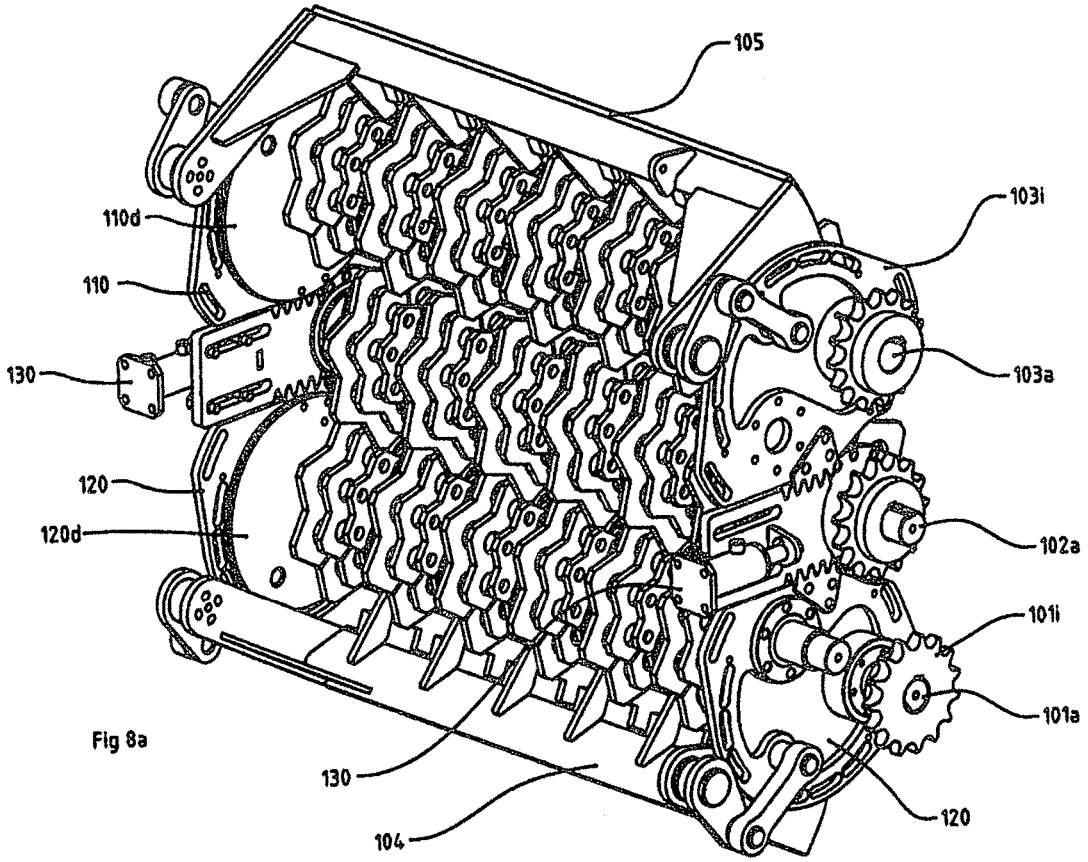
FIGS. 8*a*, 8*b*, 8*c* and 8*d* show a prospective view, a top view and two side views, respectively, of the device according to the present invention in a second working set up.
Figure 8B:
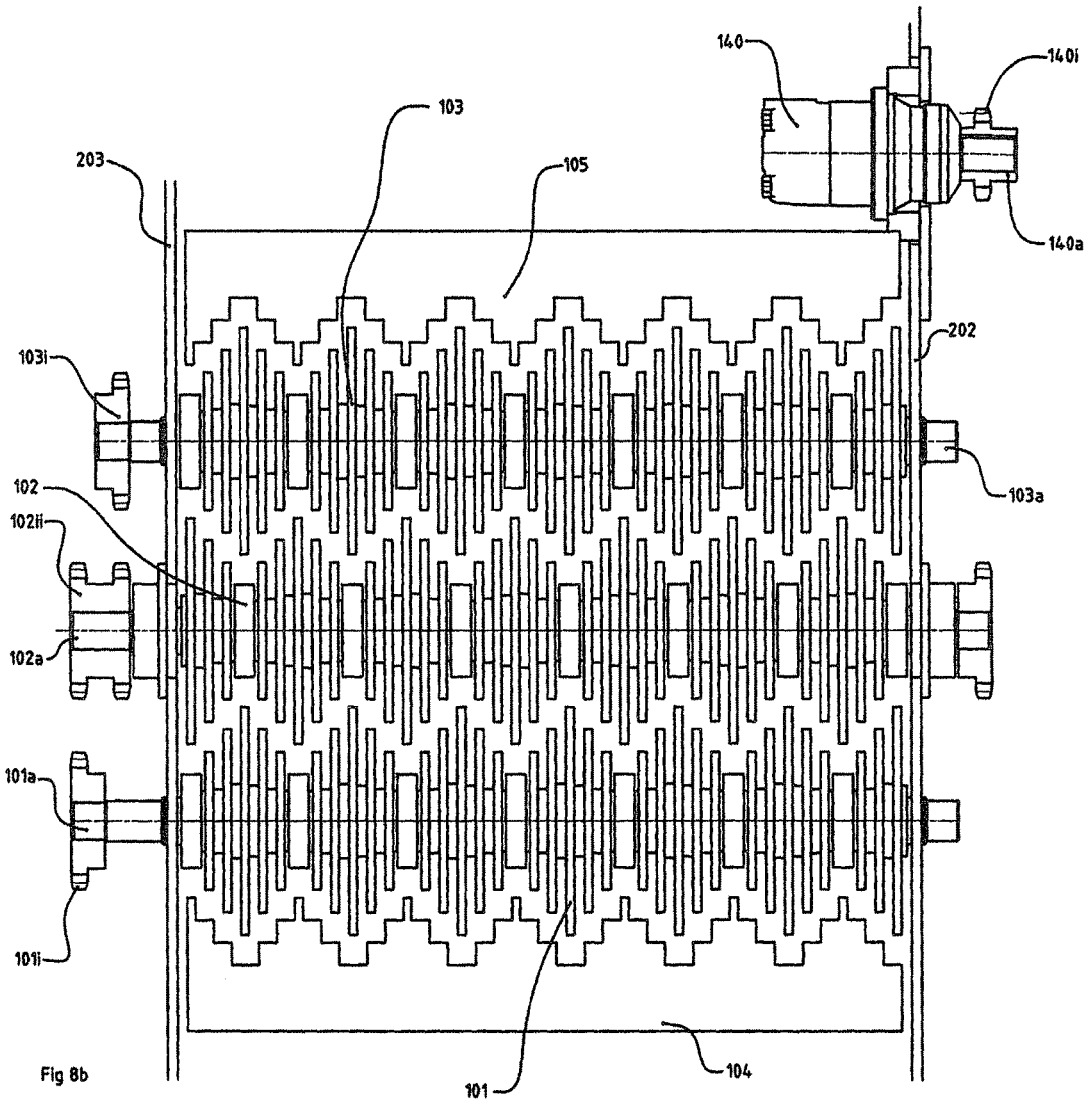
Figure 8C:
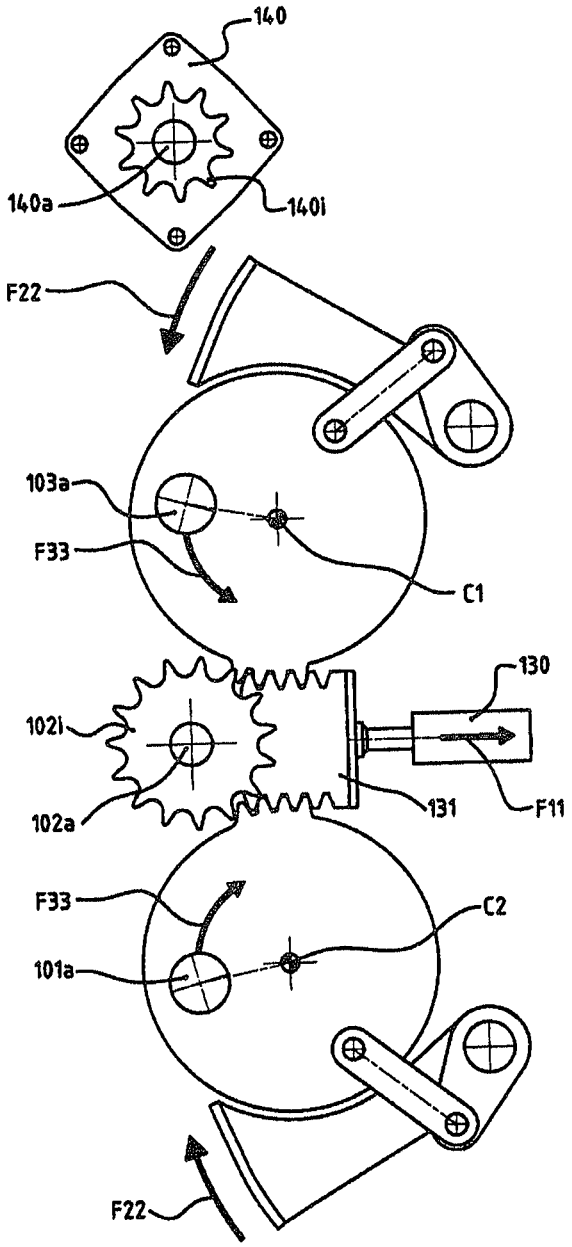
Figure 8D:
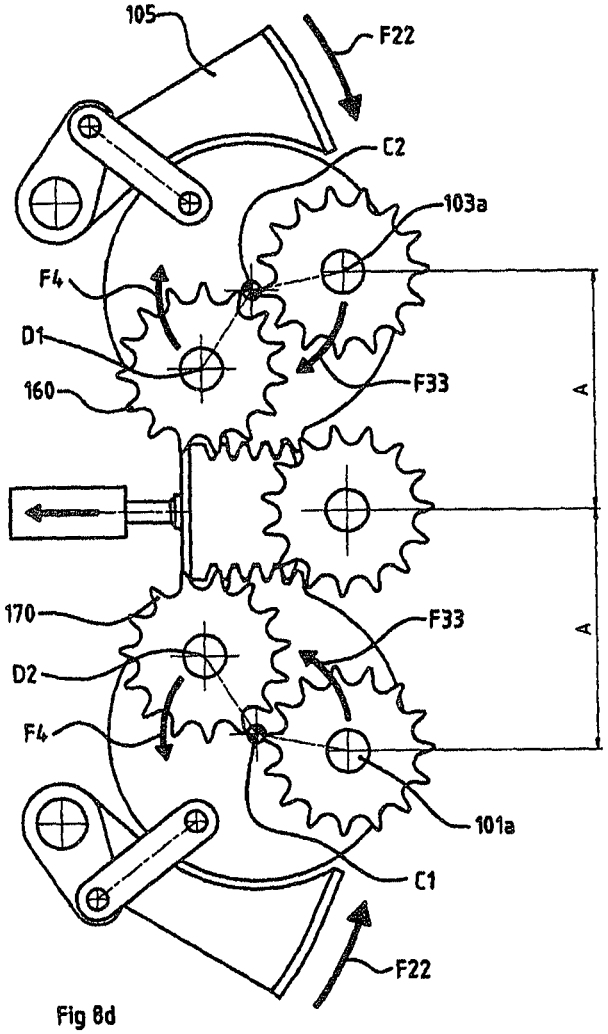
Figures 9A, 9B, 9C:
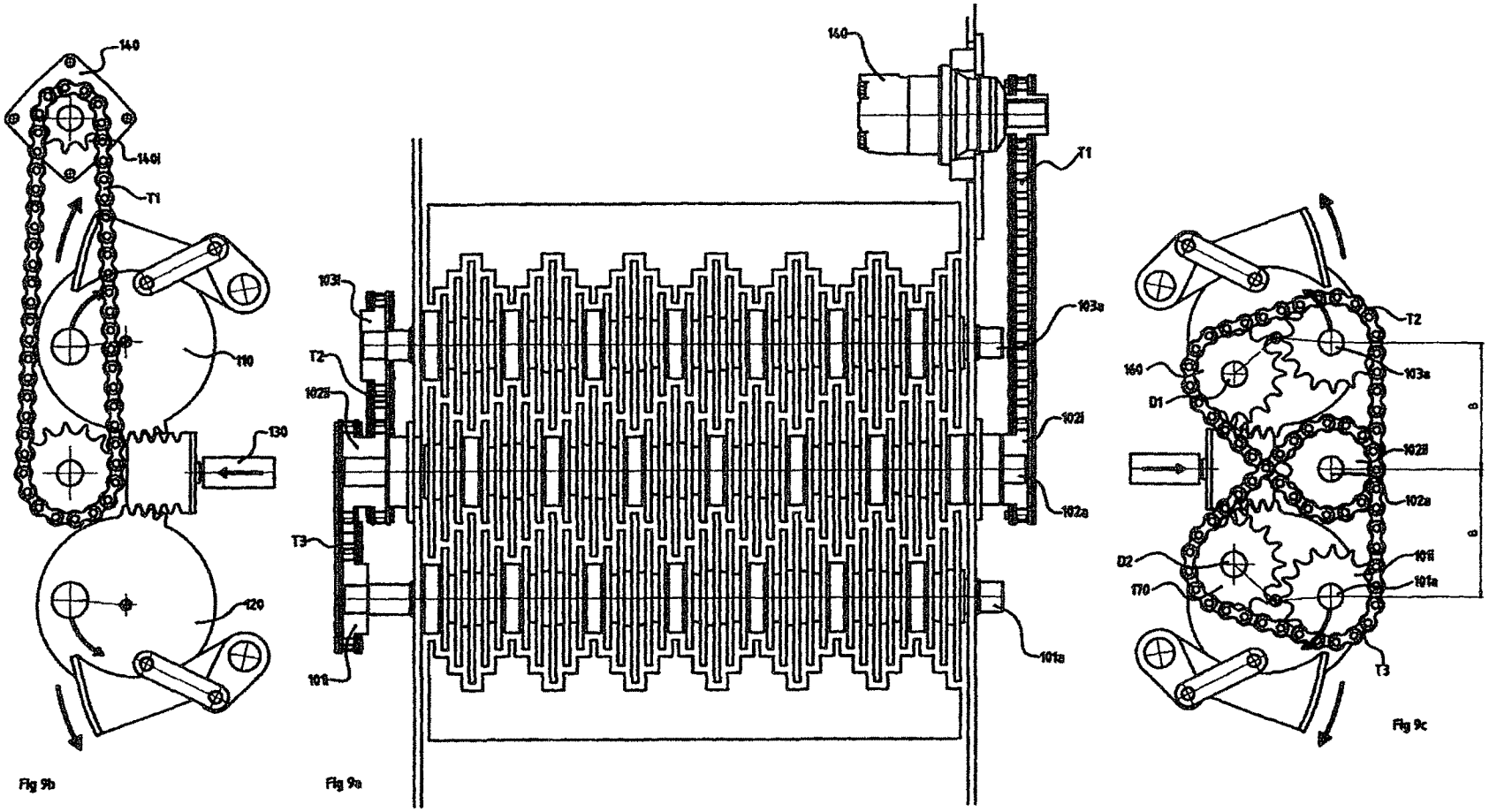
FIGS. 9*a*, 9*b* and 9*c* show a further top view and two further side views, respectively, of the device according to the present invention in said first working set up.
Figures 10A, 10B, 10C:
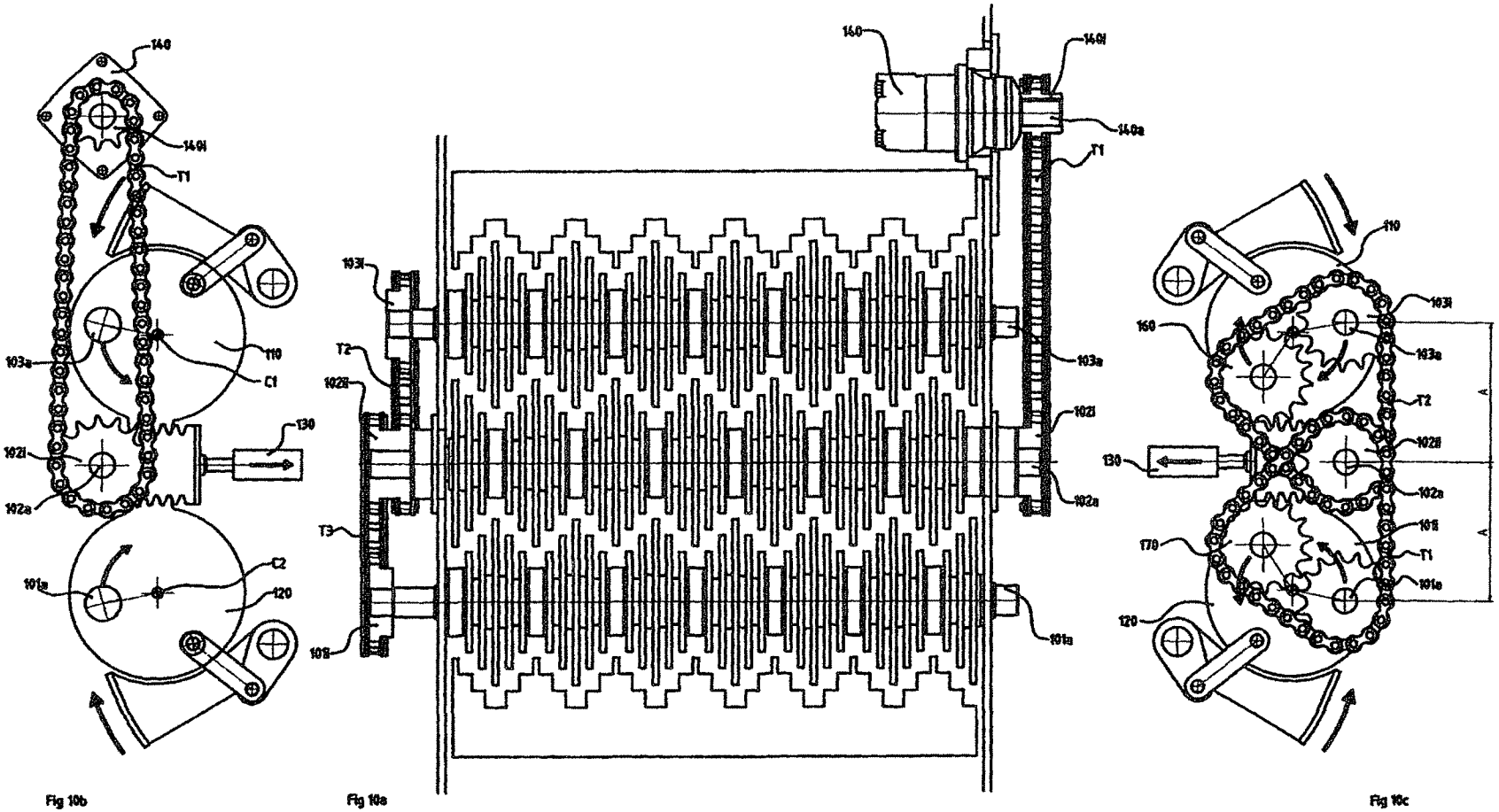
FIGS. 10*a*, 10*b* and 10*c* show a further top view and two further side views of the device according to the present invention, respectively, in said second working set up.

When looking at FIG. 7*b* it may be recognized that, to the lateral wall 202 of the main bin, there is rigidly fixed a source of power 140, for instance an hydraulic motor or pump adapted to be hydraulically connected to a main hydraulic system, for instance the hydraulic system of a main operating machine (for example an excavator); on the rotational shaft 140*a* of the motor 140 there is rigidly fixed a gear 140*i* comprising essentially gear pinion. Still on the side of the motor 140, and accordingly on the side of the lateral wall 202, on the end portion of the rotational shaft 102*a* of the second riddling roller 102, there is rigidly fixed a gear 102*i* still formed essentially by a gear pinion. The gear pinions 140*i* and 102*i* are disposed in particular one in correspondence of the other according to a plane perpendicular to the FIG. 7*b*. On the opposite side, and therefore on the side of the lateral wall 103, on the end portion of the rotational shaft 103*a* of the first riddling roller 103 which protrudes from said lateral wall 103 (and which protrudes from the third support plate 110 as depicted in FIG. 7, accordingly), there is rigidly fixed a gear 103*i* comprising essentially a gear pinion. On the end portion of the rotational shaft 102*a* of the second riddling roller 102 which protrudes from the lateral wall 203 (and therefore on the end portion of the shaft 102*a* opposite to the end portion on which there is fixed the gear 102*i*) there is fixed a gear 102*ii* comprising essentially two parallel gear pinions, the most internal of which (towards the wall 203) is disposed in correspondence of the gear pinion 103*i* according to a plane perpendicular to FIG. 7*b*. Finally, on the end portion of the rotational shaft 101*a* of the third riddling roller 101 which protrudes from the lateral wall 203 (and which protrudes therefore from the fourth support plate 120 as depicted in FIG. 7*d*) there is rigidly fixed a further gear 101*i* comprising essentially a gear pinion disposed in correspondence of the external gear pinion of the gear 102*ii*. Finally, with reference to FIG. 7*d*, it may be appreciated that, on the opposite side of the motor 140, a further gear 160 comprising essentially a gear pinion is fixed to the second support plate 110, rotatable on an axis of rotation D1 eccentric with respect to both the common axis of rotation C2 and the axis of rotation of the rotational shaft 103*a* of the first riddling roller 103. In the same way, and still on the side opposite to the motor 140, on the fourth support plate 120, there is fixed a gear 170 comprising a gear pinion rotatable on an axis of rotation D2 eccentric with respect to both the common axis of rotation C2 and the axis of rotation of the shaft 101*a* of the third roller 101.

Whilst the functioning of the gears described above will be clarified in the following with reference to figures from 9*a* to 9*c* and from 10*a* to 10*c*, it has to be clarified at this point of the description that the drawings from 8*a* to 8*d* are substantially similar to the drawings just described above from 7*a* to 7*d*. The main difference relates to the fact that the drawings from 7*a* to 7*d* represent the situation cited above and called "completely closed", whilst the FIGS. 8*a* to 8*d* represent the "completely open" situation. The component parts depicted in the figures from 8*a* to 8*d* and their reciprocal movements are similar to the component parts depicted from FIGS. 7*a* to 7*d* and their reciprocal movements, respectively. For this reason a detailed description of FIGS. 8*a* to 8*d* is omitted.

FIGS. 9*a* to 9*c* and 10*a* to 10*c* clearly show the distribution system for distributing the rotational motion of the motor 140 to the several component parts, in particular to the riddling rollers. A first transmission T1 comprising essentially a chain is disposed on the gear pinion 140*i* fixed to the rotational shaft 140*a* and on the gear pinion 102*i* fixed to the rotational shaft 102*a* of the second (intermediate) riddling roller 102. Accordingly, due to the rotation of the shaft 140*a* of the motor 140 the second riddling roller 102 will be rotated too. A second transmission T2 comprising essentially a chain is disposed on the internal pinion of the gear 102*ii* and on the pinion 103*i* fixed respectively to the rotational shaft 102*a* and the rotational shaft 103*a* so as to transmit the rotational motion from the rotational shaft 102*a* to the rotational shaft 103*a*, so that the first riddling roller 103 is trailed or driven to rotate by the second riddling roller 102. Moreover, the gear 160, adapted to rotate on the axis of rotation D1, is disposed along the second transmission T2 and exploits essentially the function described in the following; in particular, since the gear 160 is rotatably fixed to the second support plate 110 and is therefore idle, the axis of rotation D1 will follow essentially the rotational motion of said support plate 120 and of said axis of rotation of the first riddling roller 103.

That means that, by changing or varying the reciprocal position of (the distance between) the axis of rotation respectively of the first riddling roller 103 and the second riddling roller 102, also the position of the idle pinion 160 will be changed. In practice, it may be considered that the axis of rotation respectively of the shaft 102*a*, the shaft 103*a* and of the pinion 160 are disposed respectively in corresponding of the vertexes of a triangle. By changing the reciprocal disposition of said axis of rotation (as a result of a rotation of the plate 110), both the length of the sides and the size of the angles of said hypothetical triangle will change. However, the total length of the edge (perimeter) of said hypothetical triangle will remain substantially constant or unchanged with the exception of minor variations (within a range of one or two millimeters). In this way, a substantially constant tension of the transmission chain D2 will be ensured (with the exception of negligible very small variations) and without any need to use a conventional chain tensioning device, for instance of the kind with a spring, which would be however less efficient, since it would be requested to recover in a small space a remarkable difference of the length of the chain or transmission T2, and since the same chain would be stressed too much since the chain or transmission is trailed into opposite trailing directions.

In the same way, a third transmission T3 also comprising essentially a chain, is disposed on the pinions 102*ii* (the external one) and 101*i* respectively of the rotational shaft 102*a* and the rotational shaft 101*a* so as to transmit the rotational motion from the rotational shaft 102*a* to the rotational shaft 101*a*, meaning that the third riddling roller 103 is trailed or driven to rotate by the second riddling roller 102. Moreover, the idle gear or pinion 170 adapted to rotate on the axis of rotation D2 is disposed along the third transmission T3 and exploits essentially the function exploited by pinion 160; in particular since the gear 170 is rotatably fixed to the fourth support plate 120, the axis of rotation D2 will follow essentially the rotational motion of said support plate 120 and of the axis of rotation of the third riddling roller 101. That means that by varying the reciprocal position of (the distance between) the axis of rotation respectively of the third riddling roller 101 and the second riddling roller 102, also the position of the idle pinion 170 will be changed.

Practically, also in this case, it may be considered that the axis of rotation respectively of the shaft 102*a*, the shaft 101*a* and the pinion 170 are located respectively in correspondence of the vertexes of a triangle. By changing the reciprocal disposition of said axis of rotation (as a result of a rotation of the plates 120), both the lengths of the sides and the size of the angles of said hypothetical triangle will change. However, the total length of the edge (perimeter) of said hypothetical triangle will remain substantially the same (unchanged) with the exception of negligible variations (within the range of one to two millimeters). In this way, a substantially constant stress or tension of the transmission chain T3 (with the exception of minimal and negligible variations) will be ensured and, also in this case without any need to use a conventional chain tensioner such as, for instance, of the kind comprising a spring.

It has therefore been demonstrated by means of the above detailed description of the embodiments depicted in the drawings that the present invention allows to achieve the objects posed and to overcome or at least to minimize the typical drawbacks of the systems or devices known in the prior art. In particular, it has been demonstrated that the device according to the present invention allows a simple, immediate and precise regulation of the reciprocal setup of its component parts, in particular so as to select the most convenient setup for the size of the materials to be riddled. In particular, it has been demonstrated that the device according to the present invention allows to adjust or set in a simple and immediate way the reciprocal distance between the axis of rotation of the several riddling rollers, as well as the reciprocal position of the scraping elements and of the riddling rollers. Advantageously, the setting may be carried out without any need to disassemble any of the component parts, in particular of the tools fixed to the rollers and/or scraping elements. Still advantageously, the setting may be carried out using an adequate and convenient source of power, for instance the same source of power used for rotating the riddling rollers (main hydraulic system). Accordingly, the riddling device according to the present invention is particularly adapted to be applied to a bucket adapted in turn to be applied and fixed for instance to the dipper articulated arm of an excavator or excavating machine and to be actuated by the main hydraulic system of said excavating machine. Moreover, according to an embodiment of the present invention the problem of material and/or dust penetrating between the moving parts is efficiently overcome, wherein said problem, to the contrary, would reveal to be difficult to be overcome in the case in which the setup of the riddling rollers was carried out by means of supports moving rectilinearly.

Moreover, by means of a further embodiment, a substantially constant tension of the transmission chains or belts may be insured and without any need to use a conventional chain or belt tensioner. Finally, the device according to the present invention allows to face in an immediate way the working drawbacks, in particular the incidental lock of the rollers due for instance to a resistant object (as a stone trapped between them); in fact, by increasing the reciprocal distance between the rollers it will be possible to easily remove the stone or resistant object. It is moreover important to confirm once again that the present invention is not limited to the embodiments described above and depicted in the drawings. To the contrary, the scope of the present invention comprises all those alternatives of the embodiments described and depicted in the drawings which will be clear to those skilled in the art.

For instance, the device according to the present invention is adapted to be actuated by means of different sources of power and not only by hydraulic motors or systems. Moreover, the device according to the present invention is adapted to be applied not only to a bucket or a similar movable component but may be installed in fixed systems or premises. The scope of the present invention is therefore defined by the claims.

The invention claimed is:

1. A riddling device for riddling materials by separating components of different size, said device comprising:

a main bin adapted to contain said materials, with a discharging aperture for discharging during riddling components of a predefined size, a riddling system disposed substantially in correspondence of said discharging aperture and comprising a first and a second riddling rollers rotatable on respective rotation axis substantially parallel and adjacent to each other, said system comprising means adapted to modify the reciprocal distance between said two axis of rotation of said first and second riddling rollers, respectively, wherein said first riddling roller is rotatably supported by a first and a second supporting plates opposite to each other and disposed along its axis of rotation, said first and second plates being rotatable on a first common axis of rotation, the axis of rotation of said first riddling roller being eccentric with respect to said first common axis of rotation of said first and second supporting plates so that the rotation of said first and second plates on said first common axis of rotation results in said axis of rotation of said first riddling roller being translated along a first circumferential arch, characterized in that said second riddling roller is rotated by means of a power source, and in that said first riddling roller is rotatably driven by means of said second riddling roller through a driving transmission, in that said driving transmission is of the kind comprising either a belt or a chain, and in that a first deviating idle or neutral pinion gear is engaged by said driving transmission, and in that said first idle or neutral pinion gear is fixed to said second plate rotatably on a own axis of rotation eccentric with respect to said first common axis of rotation and different from said axis of rotation of said first riddling roller.

2. The device according to claim 1, wherein said means adapted to modify the reciprocal distance between said axis of rotation of said first and second riddling rollers, respectively, are adapted to rotate said first and second supporting plates on said first common axis of rotation.

3. The device according to claim 2, wherein each of said first and second supporting plates comprises a portion engaged by first and second thrust means, respectively, said thrust means being translatable along a rectilinear path alternatively in two opposite directions of translation so that the translation in a direction of translation of said first and second thrust means results in said first and second supporting plates being rotated in a first direction of rotation, whilst the translation in the opposite direction of translation of said first and second thrust means results in said first and second supporting plates being rotated in a second direction of rotation opposite to said first direction of rotation.

4. The device according to claim 1, wherein said device further comprises a third riddling roller rotatable on a own axis of rotation parallel and adjacent to said axis of rotation of said second riddling roller, and in that said system comprises means adapted to modify the reciprocal distance between said two axis of rotation of said third and second riddling rollers, respectively.

5. The device according to claim 4, wherein the axis of rotation of said third riddling roller is adapted to be translated along a second circumferential arch lying on a plane substantially perpendicular to said axis of rotation of said third riddling roller so that the translation of the axis of rotation of said third riddling roller along said second circumferential arch results in a variation of the reciprocal distance between said two axis of rotation of said third and second riddling rollers, respectively.

6. The device according to claim 5, wherein said third riddling roller is rotatably supported by a third and a fourth supporting plates opposite to each other and disposed along its axis of rotation, said third and fourth plates being rotatable on a second common axis of rotation, the axis of rotation of said third riddling roller being eccentric with respect to said second common axis of rotation of said third and fourth supporting plates so that the rotation of said third and fourth plates on said second common axis of rotation results in said axis of rotation of said third riddling roller being translated along said second circumferential arch.

7. The device according to claim 6, wherein each of said third and fourth supporting plates comprises a portion engaged by said first and second thrust means, respectively, so that the translation in a direction of translation of said first and second thrust means results in said third and fourth supporting plates being rotated in a first direction of rotation, whilst the translation in the opposite direction of translation of said first and second thrust means results in said third and fourth supporting plates being rotated in a second direction or rotation opposite to said first direction of rotation.

8. The device according to claim 4, wherein said third riddling roller is rotatably driven by said second riddling roller through a second transmission.

9. The device according to claim 8, wherein said second transmission is of the kind comprising a chain or a belt, and wherein a second deviating idle or neutral pinion gear is engaged by said second transmission.

10. The device according to claim 9, wherein said second idle or neutral pinion gear is fixed to said fourth plate rotatably on a own axis of rotation, eccentric with respect to said second common axis of rotation and different from said axis of rotation of said third riddling roller.

11. A bucket for an operating machine comprising means for operatively fixing said bucket to said operating machine so as to be activated by said operating machine, wherein said bucket comprises a device according to one of claims 1-10, and wherein the main bin of said bucket corresponds to the main bin of said device.

12. The bucket of claim 11, wherein the operating machine is an excavating machine.

* * * * *